United States Patent [19]

Foster

[11] Patent Number: 4,978,003

[45] Date of Patent: Dec. 18, 1990

[54] BRUSH HOLDER

[76] Inventor: Marjorie A. Foster, Born Free Farm, Tubwreck Dr., Dover, Mass. 02030

[21] Appl. No.: 419,121

[22] Filed: Oct. 10, 1989

[51] Int. Cl.[5] ..... B65D 77/00

[52] U.S. Cl. ..... 206/217; 206/15.2; 206/15.3; 206/361; 206/362; 132/308; 132/310; 312/206; 312/207

[58] Field of Search ..... 206/15.2, 15.3, 63.5, 206/209, 212, 306, 361, 362, 217, 581; 401/129; 312/206, 207, 229; 248/110; 132/308, 310; 220/DIG. 6

[56] References Cited

U.S. PATENT DOCUMENTS

| | | | |
|---|---|---|---|
| 1,303,884 | 5/1919 | Goodnow, Jr. . | |
| 1,336,345 | 4/1920 | Cornelius . | |
| 1,553,648 | 9/1925 | Thompson | 206/15.2 |
| 1,625,202 | 4/1927 | Gindick . | |
| 1,649,814 | 11/1927 | Lellis | 132/308 |
| 1,792,356 | 2/1931 | Boiseau | 220/DIG. 6 |
| 1,993,460 | 3/1935 | Steuernagel | 206/217 |
| 2,177,455 | 10/1939 | Hackert | 132/308 |
| 2,415,447 | 2/1947 | Stanton | 132/310 |
| 2,448,603 | 9/1948 | Kevin et al. | 206/209 |
| 2,553,232 | 5/1951 | Beyer | 206/63.5 |
| 2,817,104 | 12/1957 | Hartzell | 401/129 |
| 3,321,068 | 5/1967 | Beach | 206/212 |
| 3,880,281 | 4/1975 | Taddei | 206/217 |
| 4,033,650 | 7/1977 | Alissandratos | 312/206 |
| 4,317,605 | 3/1982 | Alissandratos | 312/206 |
| 4,768,530 | 9/1988 | Vaughn | 206/581 |
| 4,812,127 | 3/1989 | Hernandez | 132/310 |
| 4,817,826 | 4/1989 | Judge | 206/581 |

FOREIGN PATENT DOCUMENTS

| | | | |
|---|---|---|---|
| 682127 | 10/1939 | Fed. Rep. of Germany | 206/15.3 |
| 510900 | of 1939 | United Kingdom | 206/209 |
| 1286366 | 8/1972 | United Kingdom | 206/15.3 |

*Primary Examiner*—David T. Fidei
*Attorney, Agent, or Firm*—Scott R. Foster

[57] ABSTRACT

A holder for toothbrushes, the holder comprising a bottom member having a bottom portion and a continuous upstanding first wall, and a top member having a top portion and a continuous depending second wall, the first and second walls being connectable to form a chamber, the top portion having openings therein for receiving handles of toothbrushes with the top portion supporting bristle portions of the toothbrushes, the bottom member being adapted to receive and retain a disposable cup.

2 Claims, 2 Drawing Sheets

BRUSH HOLDER

BACKGROUND OF THE INVENTION

1. Field of the Invention

This invention relates to holders for brushes and is directed more particularly to holders for brushes used in conjunction with fluids and likely to drain or drip after use, as for example, toothbrushes.

2. Description of the Prior Art

It is known in the art to provide toothbrush holders which are generally cylindrically shaped, with top and bottom surfaces interconnected by a continuous wall. The top and bottom surfaces are generally circular or oval, but may be rectangular. The top surface is provided with holes which receive toothbrush handles which extend into an interior chamber of the holder. The top surface supports bristle portions of the toothbrushes. Thus, the bristles portion of a supported brush is supported by the top surface while the handle portion of the brush extends axially of the holder and inside the holder.

A problem with the above-described type of device is that after use, toothbrushes tend to drain fluid, typically a mixture of water, saliva and toothpaste. Devices as above described tend to collect such drainage over long periods of time and become unsanitary. Some holders are provided with a large hole centrally of the upper surface so that water may be admitted to the holder to wash out the accumulated debris. However, unless the device is washed with some frequency the debris clings resolutely to the bottom of the holder. In many cases, the holder, typically of a ceramic or plastic material, is discarded. Quite often, the holder is part of a matching set of bathroom accessories and loss of the holder results in diminution of the decorative effectiveness of the set.

SUMMARY OF THE INVENTION

It is an object of the present invention to provide a toothbrush holder similar in general appearance to that described above, in which the holder is separable into two parts, to facilitate access to the interior thereof.

A further object of the invention is to provide a toothbrush holder having a disposable receptacle therein and so positioned as to receive drainage from toothbrushes held by the device, such that an "old" receptacle may be disposed of and a clean new receptacle inserted, thereby facilitating maintaining a clean, sanitary holder.

With the above and other objects in view, as will hereinafter appear, a feature of the present invention is the provision of a holder for brushes, the holder including a bottom member having a bottom portion and a continuous upstanding first wall, and a top member having a top portion and a continuous depending second wall, the first and second walls being adapted to be interconnected for forming a chamber and being adapted to be readily disconnected from each other, the top portion having openings therein adapted to receive elongated handle portions of brushes, the handle portions extending into the chamber with the top portion proximate the openings being adapted to support bristle portions of the brushes externally of the chamber, and the bottom member being adapted to receive and retain a disposable receptacle for disposition in the chamber, with the non-brush end of the handle adapted to extend into the receptacle.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of the invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENTS

Figure 1:
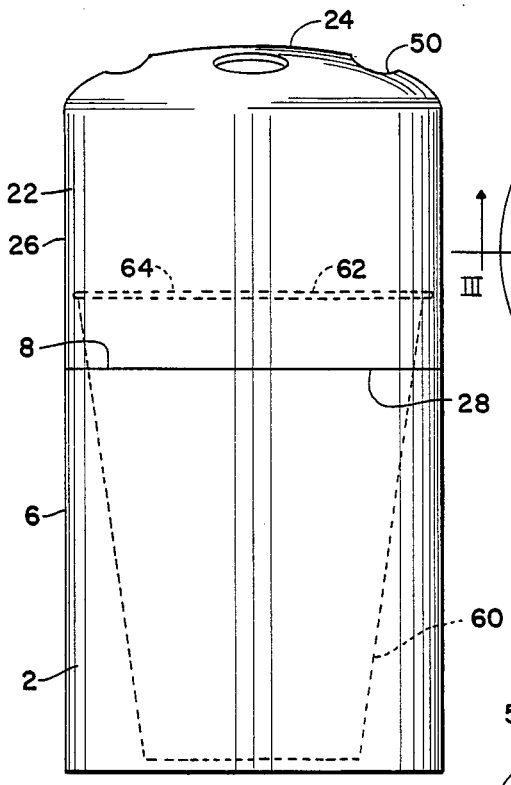
FIG. 1 is an elevational view of one form of brush holder illustrative of an embodiment of the invention.
Figure 2:
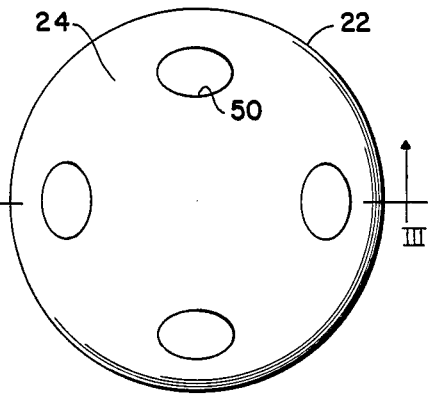
FIG. 2 is a top plan view thereof.
Figure 3:
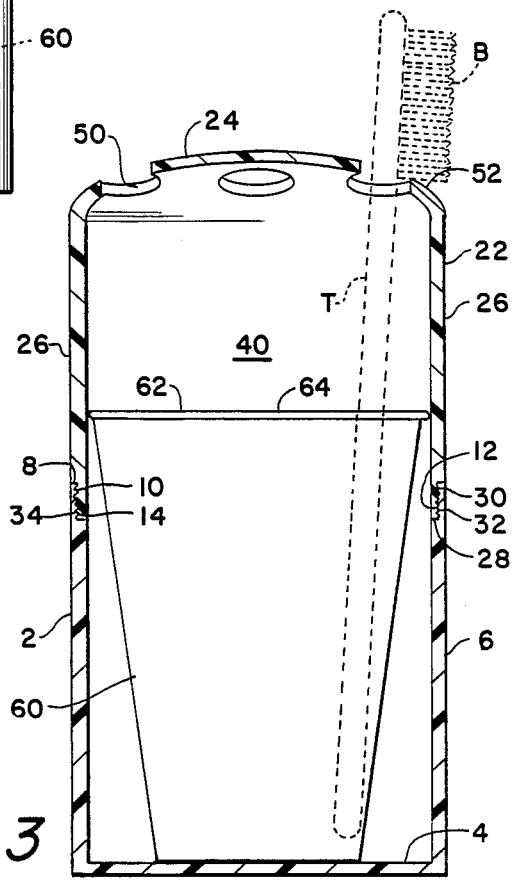
FIG. 3 is a sectional view thereof, taken along line III—III of FIG. 2.

Referring to FIGS. 1–3, it will be seen that an illustrative device includes a bottom member 2 having a bottom portion 4 and a continuous upstanding first wall portion 6. Proximate an upper rim 8 of the bottom member 2, the wall portion 6 is provided with means for connecting the bottom member 2 to a top member to be described below; such connecting means 10 may be in the form of a threaded area 12 having threads 14 engageable with the top member.

As indicated above, the device further includes a top member 22 having a top portion 24 and a continuous depending second wall portion 26. Proximate a lower rim 28 of the top member 22, the wall portion 26 is provided with means for connecting the top member 22 to the bottom member 2 such connecting means 30 may be in the form of a threaded area 32 having threads 34 engageable with the threads 14 of the bottom member 2.

Thus, the first and second wall portions 6, 26 are adapted to be interconnected for forming a chamber 40, and are adapted to be readily disconnected from each other to facilitate access to the chamber 40.

The top portion 24 is provided with openings 50 which are adapted to receive elongated handle portions H of brushes T, the handle portions H extending into the chamber 40. The top portion 24 upper surface 52 proximate the openings 50 operates to support bristle portions B of the brushes T externally of the chamber 40.

The bottom member 2 is adapted to receive and retain a disposable receptacle 60 for disposition in the chamber 40. The non-brush ends of brush handles H are adapted to extend into the receptacle A rim portion 62 of an open end 64 of the receptacle 60 is in a plane above the upper rim 8 of the bottom member 2, such that a receptacle 60 is easily grasped and removed from, or inserted into, the bottom member 2 when the top member 22 is removed. Preferably, the outside diameter of the rim 62 of the receptacle 60 is substantially equal to the inside diameter of the chamber 40 in the plane of the receptacle rim, such that debris dripping from a brush handle H or bristle portion B will not run down an interior wall of the chamber 40 and avoid the receptacle 60.

Figure 4:
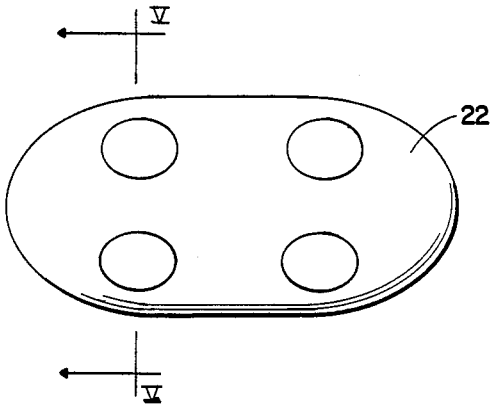
FIG. 4 is a top plan view of an alternative embodiment of the invention.
Figure 5:
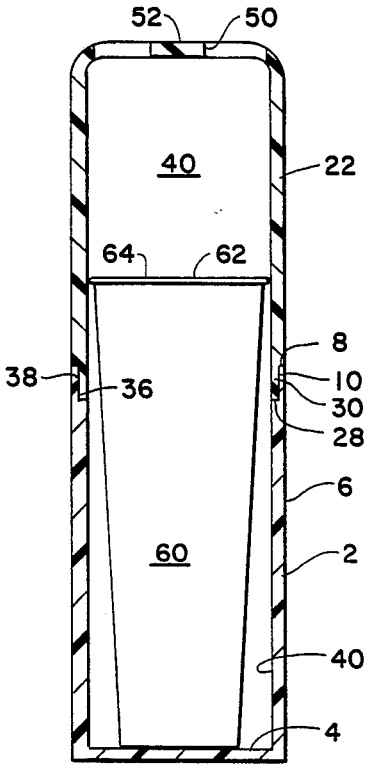
FIG. 5 is a sectional view taken along line V—V of FIG. 4.

In FIGS. 4 and 5, there is shown an alternative embodiment in which the upper and lower rims 8, 28 of the respective bottom and top members 2, 22, are provided with connecting means 10, 30 in the form of slide engagement means 36, 38 which facilitate connection of the bottom and top members 2, 22 and ready disconnection thereof. In non-circular configurations, such as the oval configuration shown in FIG. 4, the slide engagement means is appropriate. The slide engagement means may be provided with a detent and recess locking means (not shown) well known in the art. Such locking means usually provide an audible "click" when the two parts are joined, indicating to the user that the two parts are joined. The locking means is readily overcome by manual separation of the members 2, 22.

In use, the top and bottom members 22, 2 are separated and the receptacle 60 is placed on the bottom portion 4, the rim 62 of the receptacle 60 standing clear of the upper rim 8 of the bottom member first wall portion 6. The top member 22 is then screwed (or slid axially) onto the bottom member 2, with the rim 62 of the receptacle lightly engaging the interior wall of the chamber 40. The device is then ready to receive toothbrushes, or the like, as above described.

Periodically, the bottom and top members 2, 22 may be separated and the receptacle 60 removed and replaced.

The holder may be made of any suitable material. In practice, ceramics and plastics have been found most useful. The receptacle is typically a paper cup of a type generally inexpensive and available in large quantities.

It is to be understood that the present invention is by no means limited to the particular construction herein disclosed and/or shown in the drawings, but also comprises any modifications or equivalents within the scope of the disclosure.

Having thus described my invention, what I claim as new and desire to secure by Letters Patent of the United States is:

1. A holder for brushes, said holder comprising a bottom member having a bottom portion and a continuous upstanding first wall portion, and a top member having a top portion and a continuous depending second wall portion, said first and second wall portions being adapted to be interconnected for forming a chamber and being adapted to be readily disconnected from each other, said top portion having openings therein adapted to receive elongated handle portions of brushes such that said handle portions extend into said chamber, said top portion proximate said openings being adapted to support bristle portions of said brushes externally of said chamber, and a disposable receptacle which rests on said bottom portion of said holder in said chamber, with non-brush ends of said brush handles adapted to extend into said receptacle, the length of said receptacle exceeding the length of said bottom member such that with the top and bottom members separated a rim portion of an open end of said receptacle extends beyond a rim portion of an open end of said bottom member and is thereby exposed.

2. A holder for brushes in accordance with claim 1 in which the outside diameter of said receptacle rim portion is substantially equal to the inside diameter of said top member at said plane.

* * * * *